US008888213B2

(12) United States Patent
Yanaka

(10) Patent No.: US 8,888,213 B2
(45) Date of Patent: Nov. 18, 2014

(54) CIRCUIT DEVICE AND DROPLET EJECTION APPARATUS

(75) Inventor: Atsushi Yanaka, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 152 days.

(21) Appl. No.: 13/608,304

(22) Filed: Sep. 10, 2012

(65) Prior Publication Data

US 2013/0063506 A1 Mar. 14, 2013

(30) Foreign Application Priority Data

Sep. 14, 2011 (JP) ..... 2011-200784

(51) Int. Cl.
*B41J 29/38* (2006.01)
*B41J 2/045* (2006.01)

(52) U.S. Cl.
CPC ..... *B41J 2/04541* (2013.01); *B41J 2/04586* (2013.01); *B41J 2/04551* (2013.01)
USPC ..... 347/9; 347/10

(58) Field of Classification Search
None
See application file for complete search history.

(56) References Cited

U.S. PATENT DOCUMENTS

2007/0055812 A1 3/2007 Komatsu et al.
2010/0128076 A1 * 5/2010 Matsuno et al. ..... 347/10

FOREIGN PATENT DOCUMENTS

JP 04-034838 2/1992
JP 2007-258718 10/2007
JP 2009-286112 12/2009

* cited by examiner

*Primary Examiner* — Geoffrey Mruk
(74) *Attorney, Agent, or Firm* — Harness, Dickey & Pierce, P.L.C.

(57) ABSTRACT

A circuit device drives actuator elements respectively associated with a plurality of nozzles to cause droplets to be ejected from the nozzles. The circuit device includes input terminals; a receiving unit; a switching unit; and a transfer unit. The receiving unit receives, via the input terminals, input signals including a terminal arrangement signal and drive signals for driving the actuator elements. The terminal arrangement signal indicates a type of assignment of signals to be assigned to the input terminals. The switching unit switches the assignment of signals in accordance with the terminal arrangement signal. The transfer unit transfers, to the actuator elements, drive signals that are input to the input terminals after the assignment of signals has been switched.

12 Claims, 9 Drawing Sheets

CIRCUIT DEVICE AND DROPLET EJECTION APPARATUS

CROSS-REFERENCE TO RELATED APPLICATIONS

The present application claims priority to and incorporates by reference the entire contents of Japanese Patent Application No. 2011-200784 filed in Japan on Sep. 14, 2011.

BACKGROUND OF THE INVENTION

1. Field of the Invention

The present invention relates to a circuit device for driving a droplet ejection head that ejects droplets to form an image, and a droplet ejection apparatus on which the circuit device is mounted.

2. Description of the Related Art

Widely-known schemes for ejecting ink adopted by print-on-demand inkjet heads (droplet ejection heads) include a scheme that uses a piezoelectric actuator or the like and a scheme that uses a heating element that generates heat when electric current flows therethrough. The former scheme is carried out by arranging a diaphragm in a portion of a wall of a liquid chamber filled with ink (droplet) and displacing the diaphragm using the piezoelectric actuator or the like to increase a pressure in the liquid chamber, thereby causing the ink to be ejected. The latter scheme is carried out by arranging the heating element in a liquid chamber filled with ink (droplet) and increasing a pressure in the liquid chamber with an air bubble generated by heat from the heating element, thereby causing the ink to be ejected. Inkjet recording apparatuses (printers) are used by a large number of people in diverse applications because inkjet recording apparatuses (droplet ejection apparatuses) that include such inkjet heads as described above become increasingly less expensive and enhanced in image quality, and also because personal computers (PCs) have become widespread in homes.

In recent years, there are demands for miniaturization of printers and functional enhancement in performance of a driver integrated circuit (IC) as print speeds of inkjet recording apparatuses increase. In particular, the performance of a driver IC affects not only performance of the apparatus but also manufacturing cost of surrounding associated parts.

Under the circumstances, an integrated circuit device and electronic equipment including an interface circuit that allows mount of a component and the like on any one of a front surface and a back surface of a substrate are disclosed in Japanese Patent Application Laid-open No. 2007-258718, for example. This integrated circuit device is configured such that terminals are arranged in line symmetry with respect to a center axis of the terminal array, and a driver IC is mounted on a selected one of the front surface and the back surface of the substrate.

Some of shuttle-type inkjet recording apparatuses include a drive circuit on an apparatus body to minimize the weight of a movable unit of the inkjet recording apparatus to achieve a higher print speed. In this case, it is required to arrange, on the movable unit, a relay board that connects between the apparatus body and the movable unit to transmit input signals generated by the drive circuit on the apparatus body to the movable unit. In a case where a driver IC of a single type is used to drive multiple heads (droplet ejection heads), wiring on the relay board is generally complicated, which undesirably arises the need of employing a multi-layer circuit board. This is because the number of input signal lines has increased in recent years to implement complicated driver IC control.

The integrated circuit device disclosed in Japanese Patent Application Laid-open No. 2007-258718 achieves miniaturization by allowing mount of a component and the like on any one of the front surface and the back surface of the substrate on a signal-receiving side. However, the integrated circuit device disclosed in Japanese Patent Application Laid-open No. 2007-258718 relates to the configuration of the substrate on the signal-receiving side itself but does not simplify the configuration of a circuit board, such as the relay board described above, on a side from which input signals generated within the apparatus body are transmitted.

Therefore, there is a need for a circuit device and a droplet ejection apparatus capable of simplifying a layer structure of a circuit board on a side from which input signals are to be transmitted to reduce manufacturing cost.

SUMMARY OF THE INVENTION

According to an embodiment, there is provided a circuit device that drives actuator elements respectively associated with a plurality of nozzles to cause droplets to be ejected from the nozzles. The circuit device includes input terminals; a receiving unit; a switching unit; and a transfer unit. The receiving unit receives, via the input terminals, input signals including a terminal arrangement signal and drive signals for driving the actuator elements. The terminal arrangement signal indicates a type of assignment of signals to be assigned to the input terminals. The switching unit switches the assignment of signals in accordance with the terminal arrangement signal. The transfer unit transfers, to the actuator elements, drive signals that are input to the input terminals after the assignment of signals has been switched.

According to another embodiment, there is provided a droplet ejection apparatus that ejects droplets from a plurality of nozzles. The droplet ejection apparatus includes a circuit device that includes input terminals and drives actuator elements, the actuator elements individually being respectively associated with the plurality of nozzles; a signal generator that generates input signals including a terminal arrangement signal and drive signals for driving the actuator elements, the terminal arrangement signal indicating a type of assignment of signals to be assigned to the input terminals; and a transmitting unit that transmits the input signals to the circuit device. The circuit device includes a receiving unit that receives, via the input terminals, the input signals; a switching unit that switches the assignment of signals in accordance with the terminal arrangement signal; and a transfer unit that transfers, to the actuator elements, drive signals that are input to the input terminals after the assignment of signals has been switched.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments are described in detail below with reference to the accompanying drawings. In an embodiment, an example where a droplet ejection apparatus is embodied as an inkjet recording apparatus that uses droplet ejection heads that eject ink (droplets) is described.

Figure 1:
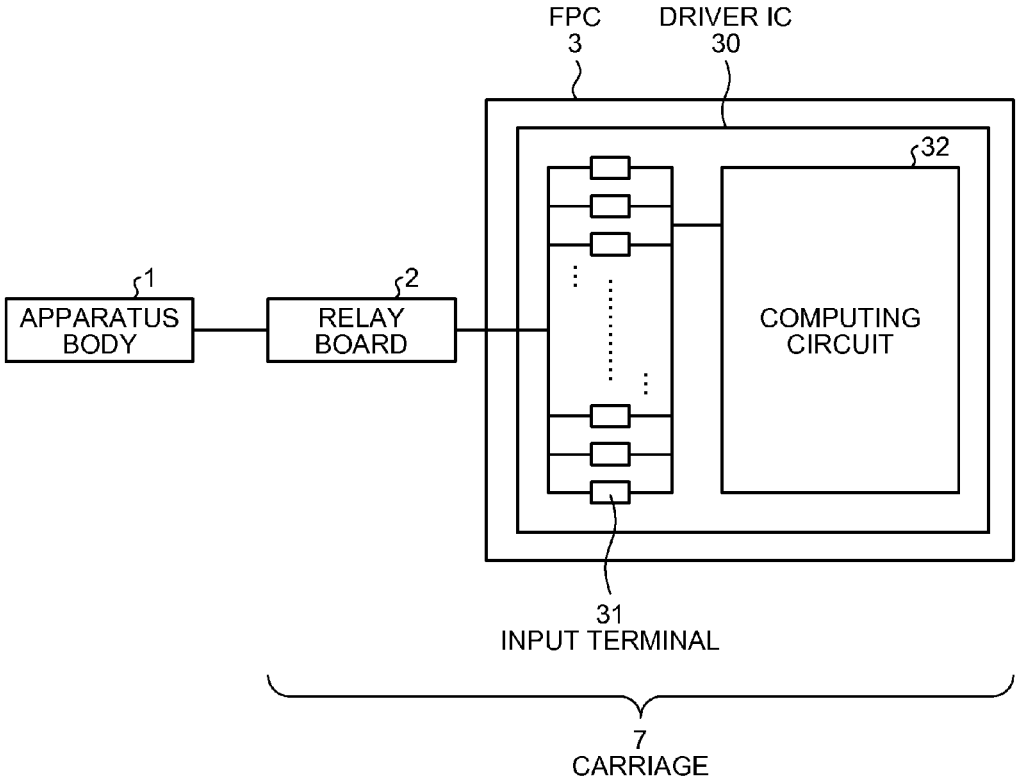
FIG. 1 is a schematic diagram illustrating the configuration of an inkjet recording apparatus according to an embodiment of the present invention.

FIG. 1 is a schematic diagram illustrating a hardware configuration of the inkjet recording apparatus according to the present embodiment. As illustrated in FIG. 1, the inkjet recording apparatus includes an apparatus body 1 and a movable carriage 7. The carriage 7 includes a relay board 2 to be connected to the apparatus body 1, a driver IC 30 that includes input terminals 31, and a droplet ejection head (not shown in FIG. 1).

The driver IC 30 is mounted on flexible printed circuits (FPC) 3, and includes the input terminals 31 and a computing circuit 32. The FPC 3 and the apparatus body 1 are connected to each other via the relay board 2.

In the inkjet recording apparatus according to the present embodiment, the droplet ejection head includes a plurality of nozzles each of which is provided with its own separate liquid chamber. An actuator (actuator element) is provided for each of the separate chambers to apply a pressure thereto. The actuators are individually driven at predetermined print timing in accordance with drive signals to cause ink (droplets) to be ejected from the nozzles. Recording on a recording medium is performed in this way.

In the present embodiment, the apparatus body 1 generates input signals that include the drive signals, and transmits the generated input signals to the driver IC 30 via the relay board 2. The driver IC 30 transfers the drive signals included in the received input signals to the actuators, thereby causing ink to be ejected from the nozzles.

The input terminals 31 are connection terminals for receiving various types of signals. In the present embodiment, the input terminals 31 receive input signals from the apparatus body 1 via the relay board 2.

The computing circuit 32 includes a variety of logic circuits and carries out various computations.

Figure 2:
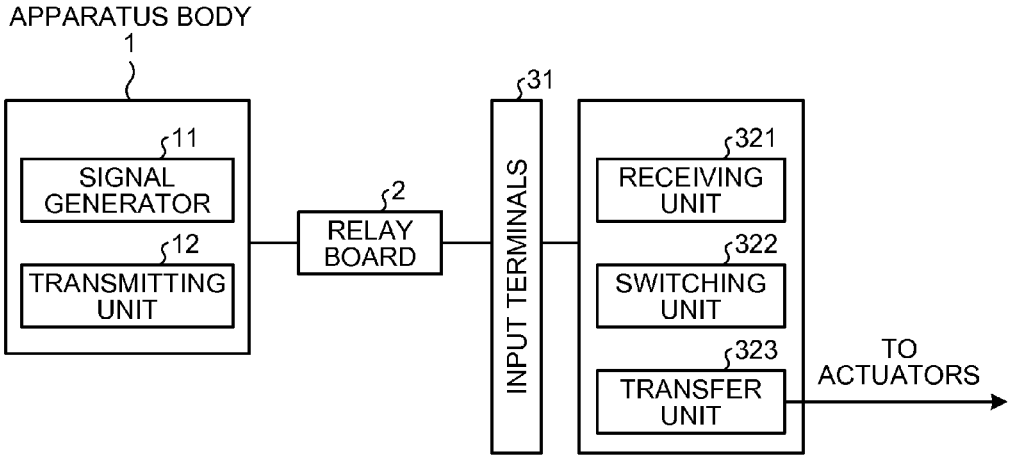
FIG. 2 is a functional block diagram of the inkjet recording apparatus according to the embodiment.

FIG. 2 is a block diagram illustrating a functional configuration of the inkjet recording apparatus according to the present embodiment. The apparatus body 1 includes a signal generator 11 and a transmitting unit 12.

The signal generator 11 generates the input signals to be transmitted to the input terminals 31 of the driver IC 30. The input signals generated by the signal generator 11 are signals for driving the actuators so that ink is ejected from the nozzles. The input signals are made up of 24 types of signals. The 24 types of signals include a signal for a power supply line, drive signals for driving various types of actuators, and a terminal arrangement signal (Mode2) that indicates a type of assignment of signals to be assigned to the input terminals 31.

The transmitting unit 12 transmits the input signals generated by the signal generator 11 to the driver IC 30 via the relay board 2.

The driver IC 30 is described below. In the inkjet recording apparatus according to the present embodiment, the computing circuit 32 (see FIG. 1) implements functions of a receiving unit 321, a switching unit 322, and a transfer unit 323, and changes assignment of logic signals to the input terminals 31 of the driver IC 30.

The receiving unit 321 receives the input signals generated by the signal generator 11 of the apparatus body 1.

The switching unit 322 changes assignment of signals to be assigned to the input terminals 31 in accordance with the terminal arrangement signal.

Figure 3A:
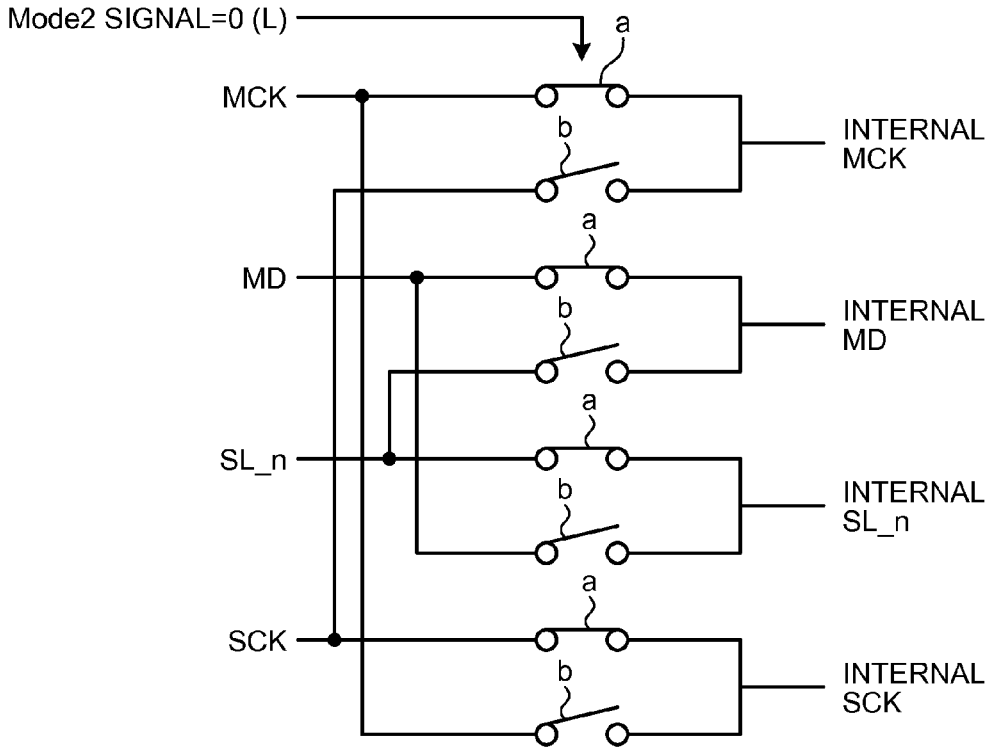
FIG. 3A is an explanatory diagram of positions where switches for input terminals are put when a terminal arrangement signal is at low level (Mode2=L)
Figure 3B:
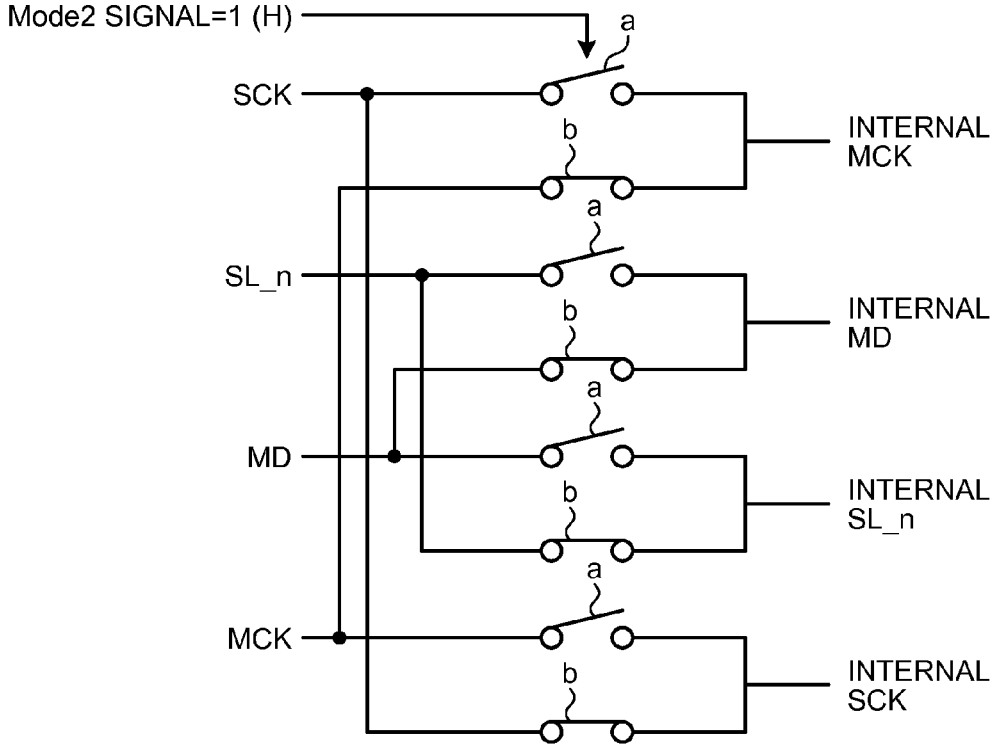
FIG. 3B is an explanatory diagram of positions where the switches for the input terminals are put when the terminal arrangement signal is at high level (Mode2=H)

How the switching unit 322 changes the assignment of signals to be assigned to the input terminals 31 is concretely described below. FIG. 3A is an explanatory diagram of positions where switches for the input terminals are put when the terminal arrangement signal is at low level (Mode2=L). FIG. 3B is an explanatory diagram of positions where the switches for the input terminals are put when the terminal arrangement signal is at high level (Mode2=H). Switches a and switches b illustrated in FIGS. 3A and 3B are an example of the switching unit 322.

An assignment of internal signals in the driver IC 30 is fixed. For example, FIGS. 3A and 3B illustrate an example where signals are assigned in an order of an internal MCK signal, an internal MD signal, an internal SL_n signal, and an internal SCK signal from top to bottom.

When the driver IC 30 receives input signals including the terminal arrangement signal of low level, the switches a are put in the ON position, while the switches b are put in the OFF position. An MCK signal, an MD signal, an SL_n signal, and an SCK signal are input to the input terminals 31 of the driver IC 30 in this order from top to bottom in FIG. 3A. At this time, because the switches a are ON, the MCK signal is input to the internal MCK signal; the MD signal is input to the internal MD signal; the SL_n signal is input to the internal SL_n signal; the SCK signal is input to the internal SCK signal.

When the driver IC 30 receives input signals including the terminal arrangement signal of high level, the switches a are put in the OFF position, while the switches b are put in the ON position. An SCK signal, an SL_n signal, an MD signal, and an MCK signal are input to the input terminals 31 of the driver IC 30 in this order from top to bottom in FIG. 3B. Although the input signals illustrated in FIG. 3B are in reverse order to that illustrated in FIG. 3A, because the switches b are ON, the MCK signal is input to the internal MCK signal; the MD signal is input to the internal MD signal; the SL_n signal is input to the internal SL_n signal; the SCK signal is input to the internal SCK signal.

The driver IC 30 is configured as described above. Accordingly, external signals (input signals) that conform to internal signals are invariably input to the driver IC 30.

Figure 4A:
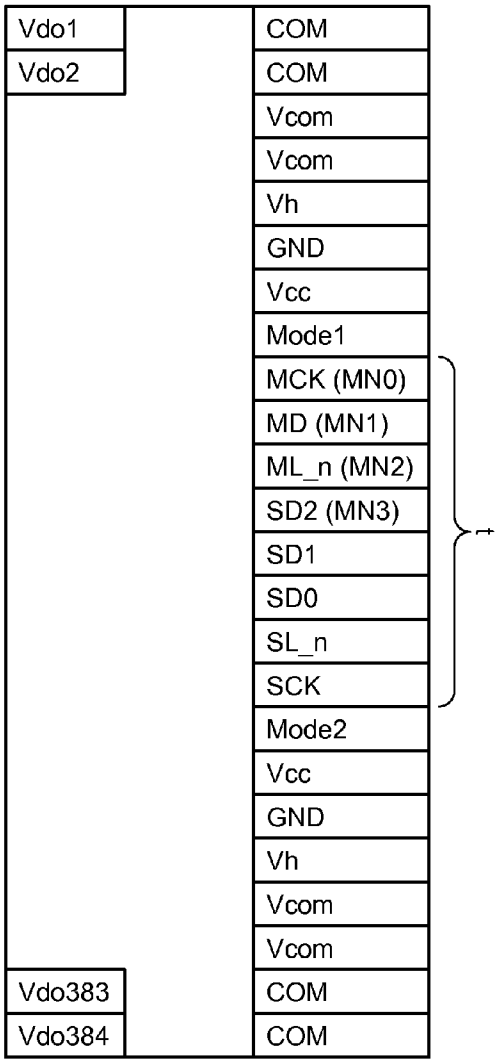
FIG. 4A is a diagram illustrating an example of assignment of signals to be assigned to input terminals.
Figure 4B:
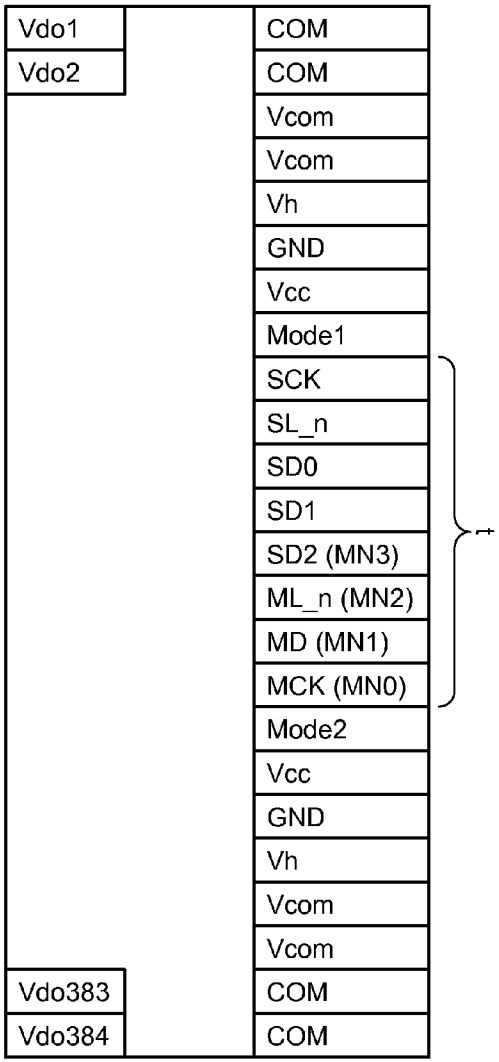
FIG. 4B is a diagram illustrating an example of assignment of signals to be assigned to the input terminals.

Assignment of signals to be assigned to the input terminals 31 is described below. FIGS. 4A and 4B are diagrams each illustrating an example of assignment of signals to be assigned to the input terminals. The terminal arrangement signal (Mode2) included in the input signals received from the apparatus body 1 indicates a type of assignment of signals to be assigned to the input terminals 31 by H (high level) or L (low level). More specifically, there two types of assignment of signals to be assigned to the input terminals 31. The two types are a first signal order corresponding to H of the terminal arrangement signal and a second signal order corresponding to L of the terminal arrangement signal. FIG. 4A illustrates assignment in the first signal order when the terminal arrangement signal is at high level (Mode2=H). FIG. 4B illustrates assignment in to the second signal order when the terminal arrangement signal is at low level (Mode2=L).

The signals assigned to terminals in a range t illustrated in FIGS. 4A and 4B are the drive signals for driving the actuators. Comparison between an order of signals assigned to the input terminals in the range t illustrated in FIG. 4A and that illustrated in FIG. 4B is made below. The order of the signals (the first signal order) assigned to the input terminals in the range t illustrated in FIG. 4A is an MCK (MN0) signal, an MD (MN1) signal, an ML_n (MN2) signal, an SD2 (MN3) signal, an SD1 signal, an SD0 signal, an SL_n signal, and an SCK signal from left to right.

The order of the signals assigned to the input terminals in the range t illustrated in FIG. 4B is reversed order of the order of the signals illustrated in FIG. 4A. More specifically, the order of the signals (the second signal order) assigned to the terminals in the range t illustrated in FIG. 4B is an SCK signal, an SL_n signal, an SD0 signal, an SD1 signal, an SD2 (MN3) signal, an ML_n (MN2) signal, an MD (MN1) signal, and an MCK (MN0) signal from left to right.

When the terminal arrangement signal (Mode2) included in the input signals is H, the drive signals are assigned to the input terminals 31 as illustrated in FIG. 4A. When the terminal arrangement signal (Mode2) included in the input signals is L, the drive signals are assigned to the input terminals 31 as illustrated in FIG. 4B.

First, the switching unit 322 determines whether the terminal arrangement signal (Mode2) included in the received input signals is H or L. When the switching unit 322 determines that the terminal arrangement signal is H, the switching unit 322 refers to assignment patterns of signals stored in a storage unit (not shown) and switches the assignment of signals assigned to the arrangement of the input terminals 31 to the assignment (a first assignment) illustrated in FIG. 4A. On the other hand, when the switching unit 322 determines that the terminal arrangement signal is L, the switching unit 322 refers to the assignment patterns of signals stored in the storage unit and switches the assignment of signals assigned to the input terminals 31 to the assignment (a second assignment) illustrated in FIG. 4B.

The transfer unit 323 transfers, to the actuators, drive signals that are input to the input terminals 31 after the assignment of signals has been switched. The actuators are driven on this drive signals to cause ink to be ejected from the nozzles.

Figure 5:
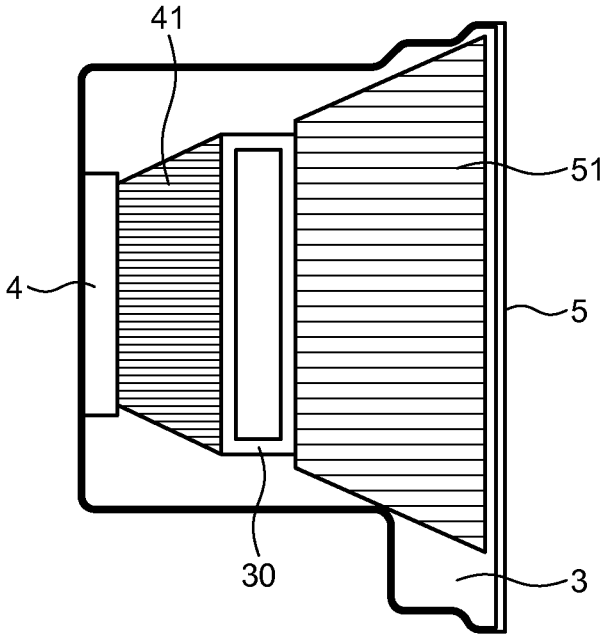
FIG. 5 is a diagram illustrating a driver IC mounted on an FPC.

The driver IC 30 mounted on the FPC 3 is described below. FIG. 5 is a diagram illustrating the driver IC mounted on the FPC.

The driver IC 30 is mounted on the FPC 3 as illustrated in FIG. 5. Input signals are input to the driver IC 30 via a connection electrode 4 through wiring 41. The drive signals are transferred via a lead zirconate titanate (PZT) connection electrode 5 to the actuators through the wiring 51.

Driver ICs are expensive parts and become a considerably large load in a development cost. Due to the circumstance, it is desired that a larger number of models employ the driver IC as common parts. When the driver IC 30 according to the present embodiment is mounted on the FPC 3, the driver IC 30 transfers the drive signals to the actuators immediately upstream of connection between the FPC 3 and the actuators.

The input signals input to the driver IC 30 are common signals that are input to the liquid ejection heads and the nozzle lines. The number of input lines in the present embodiment is 24 (24 types). Accordingly, the input signals are input to the driver IC 30 in a condition where ambient noise is relatively low. It is possible to transfer drive waveforms, which are very important, based on such input signals to the actuators over short distances. Furthermore, employment of the FPC 3 allows forming a fine-pitch wiring pattern. In the present embodiment, the wiring pattern has a pitch of, for example, one hundred and several tens μm.

The FPC 3 on which the driver IC 30 is mounted is also an expensive component. However, assignment of signals to be assigned to the input terminals 31 can be performed in a line-symmetrical manner because the driver IC 30 mounted on the FPC 3 has the terminal arrangement signal (Mode2).

Figure 6A:
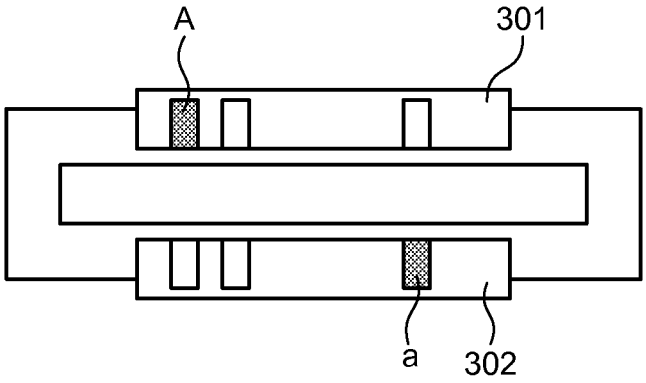
FIG. 6A is an explanatory diagram of the input terminals in a configuration where input signals do not include the terminal arrangement signal.
Figure 6B:
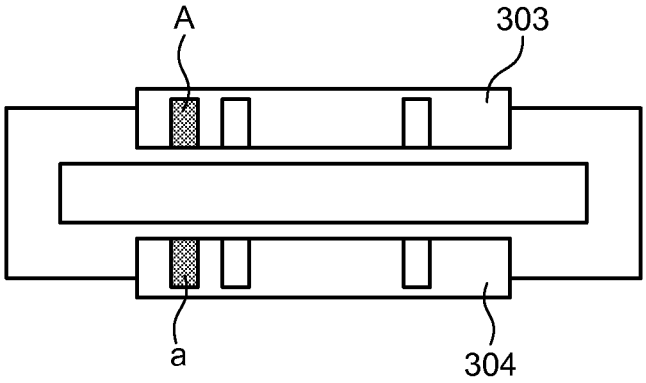
FIG. 6B is an explanatory diagram of the input terminals in a configuration where input signals include the terminal arrangement signal.

Next, arrangements of the input terminals 31 are described below based on comparison with respect to presence/absence of the terminal arrangement signal. FIG. 6A is an explanatory diagram of the input terminals in a configuration where input signals do not include the terminal arrangement signal. FIG. 6B is an explanatory diagram of the input terminals in the configuration where input signals include the terminal arrangement signal. Each of FIGS. 6A and 6B illustrates a single droplet ejection head on which two nozzle lines are formed.

In the configuration where the input signals do not include the terminal arrangement signal, arrangements of the input terminals 31 mounted on two units of the FPC 3 (which are referred to as an FPC 301 and an FPC 302) facing each other are not line symmetrical as illustrated in FIG. 6A. More specifically, because assignment of signals to be assigned to the arrangement of the input terminals 31 is unchangeable, orders of the terminals arranged on the two FPC 3 facing each other are reverse to each other. For example, referring to FIG. 6A, a terminal A is on the left side on the FPC 301, while the terminal A is on the right side on the FPC 302. Accordingly, when input signals are input to each of the FPC 301 and the FPC 302, different signals are input to each pair of terminals facing each other. This makes wiring on the relay board 2 complicated when the relay board 2 is used as in the present embodiment. Furthermore, this undesirably increases the number of layers of the relay board 2 in order to avoid wire crossing.

In contrast, when the input signals include the terminal arrangement signal, assignment of signals to be input to the terminals is changeable. Therefore, it is possible to arrange the input terminals 31 mounted on two units of the FPC 3 (which are referred to as an FPC 303 and an FPC 304) facing each other in line symmetry as illustrated in FIG. 6B. More specifically, because assignment of signals to be assigned to the arrangement of the input terminals 31 is changeable, the terminals are to be arranged on the two FPC 3 facing each other in a same order. For example, referring to FIG. 6B, the terminal A is on the left side on both the FPC 303 and the FPC 304. Accordingly, when input signals are input to each of the FPC 303 and the FPC 304, a same signal is input to each pair of terminals facing each other. This simplifies wiring on the relay board 2 when the relay board 2 is used as in the present embodiment. Therefore, the number of layers of the relay board 2 can be reduced without wire crossing.

Next, the relay board 2 is described below. The relay board 2 is a circuit board on which the wiring pattern is formed. The relay board 2 connects between the apparatus body 1 and the FPC 3 on which the driver IC 30 is mounted as described above, receives input signals generated by the apparatus body 1, and transmits the input signals to the driver IC 30.

Figure 7A:
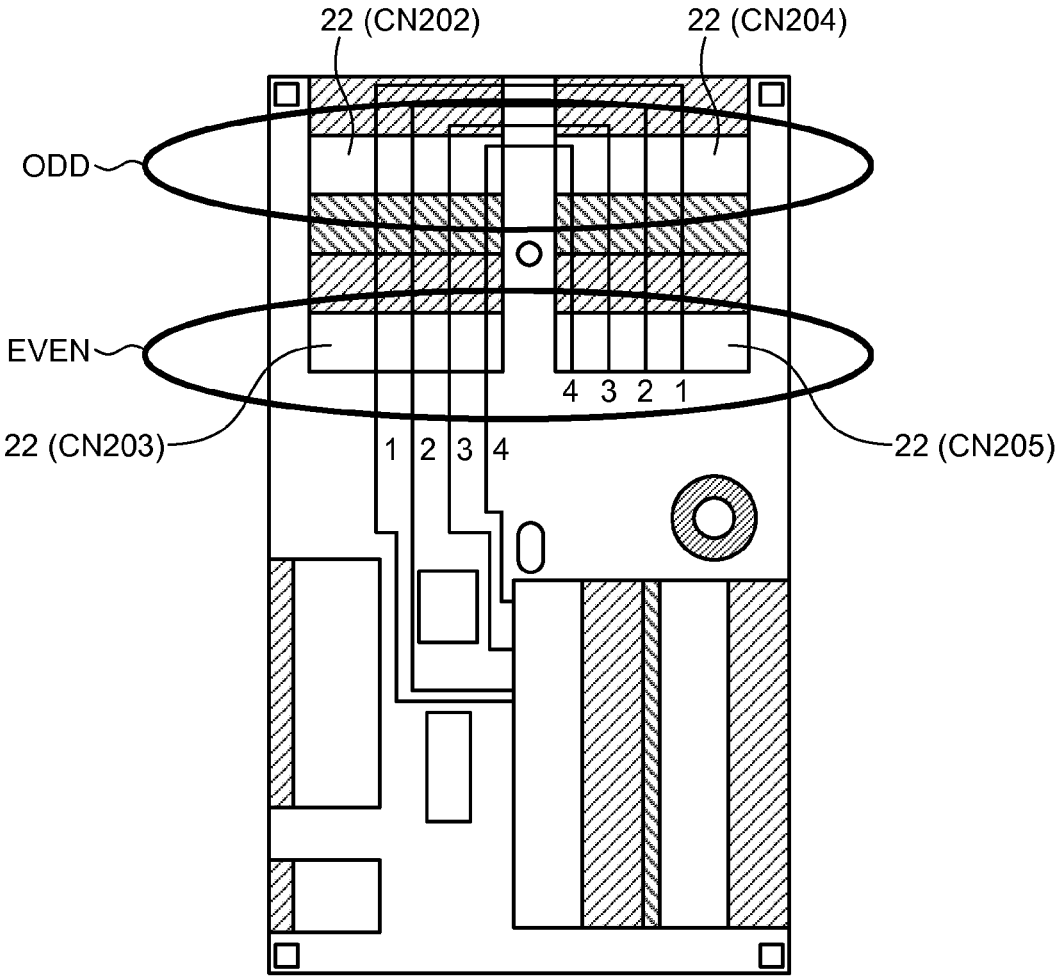
FIG. 7A is a diagram illustrating an example of a relay board.

FIG. 7A is a diagram illustrating an example of the relay board. The relay board 2 includes head connectors 22 for connection to the droplet ejection heads as illustrated in FIG. 7A. In FIG. 7A, signals are assigned to the input terminals 31 on a per-nozzle-line basis. More specifically, the head connectors 22 (CN202 and CN203) are used to drive a single liquid ejection head on which two nozzle lines are formed. Similarly, the head connectors 22 (CN204 and CN205) are used to drive a single liquid ejection head on which two nozzle lines are formed.

When same signals are input to input terminals on ODD side and input terminals on EVEN side that face each other of the droplet ejection head illustrated in FIG. 7A, wiring on the relay board 2 is simplified as described above (see FIG. 6B), and the number of layers of the relay board 2 can be reduced. As a result, miniaturization can be achieved. In contrast, when different signals are input to the input terminals on ODD side and the input terminals on EVEN side that face each other of the droplet ejection head, wiring on the relay board 2 is complicated as described above (see FIG. 6A). As a result, the number of layers of the relay board 2 and/or size of the relay board 2 undesirably increases.

Illustrated in FIG. 7A is a wiring pattern of data lines in which terminal arrangements of the head connectors 22 (CN202 and CN203) are symmetrical such that CN202 has the terminal arrangement corresponding to H of the terminal arrangement signal (Mode2), and CN203 has the terminal arrangement corresponding to L of the terminal arrangement signal (Mode2). Similarly, in the wiring pattern of data lines, terminal arrangements of the head connectors 22 (CN204 and CN205) are symmetrical such that CN204 has the terminal arrangement corresponding to H of the terminal arrangement signal (Mode2), and CN205 has the terminal arrangement corresponding to L of the terminal arrangement signal (Mode2). In FIG. 7A, wires of the data lines are indicated as lines 1, 2, 3, and 4. Changing assignment of signals to be input to the input terminals 31 using the terminal arrangement signal in this way simplifies wiring without wire crossing. This allows installing wiring only on an uppermost layer of the circuit board (the relay board 2).

Meanwhile, FIG. 7A illustrates an example where each of CN202 and CN204 has the terminal assignment corresponding to H of the terminal arrangement signal, and each of CN203 and CN205 has the terminal assignment corresponding to L of the terminal arrangement signal. Alternatively, an arrangement where the ODD side (CN202 and CN204) has the terminal assignment corresponding to L of the terminal arrangement signal, and the EVEN side (CN203 and CN205) has the terminal assignment corresponding to H of the terminal arrangement signal can be employed.

Figure 7B:
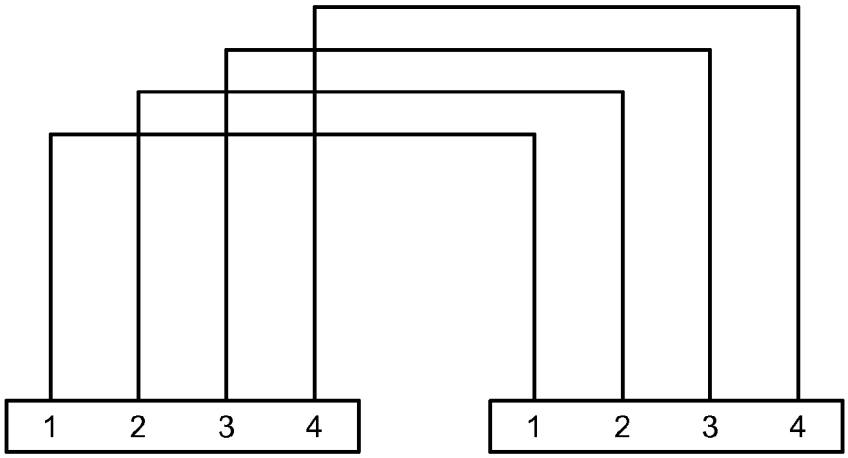
FIG. 7B is a diagram illustrating wiring on a relay board in a configuration where assignment of signals to be assigned to input terminals is unchangeable.

FIG. 7B is a diagram illustrating wiring on a relay board in a configuration where assignment of signals to be assigned to the input terminals is unchangeable. When the wires 1 to 4 of the relay board 2 are connected to the FPC 3 on which the driver IC 30 is mounted in the configuration where signal assignment is unchangeable, each of the wires 1, 2, 3, and 4 undesirably has wire crossing as illustrated in FIG. 7B. In such a case, a relay board is to be provided for each of the wires. As a result, a need of using a relay board made up of four layers undesirably arises.

Figure 8:
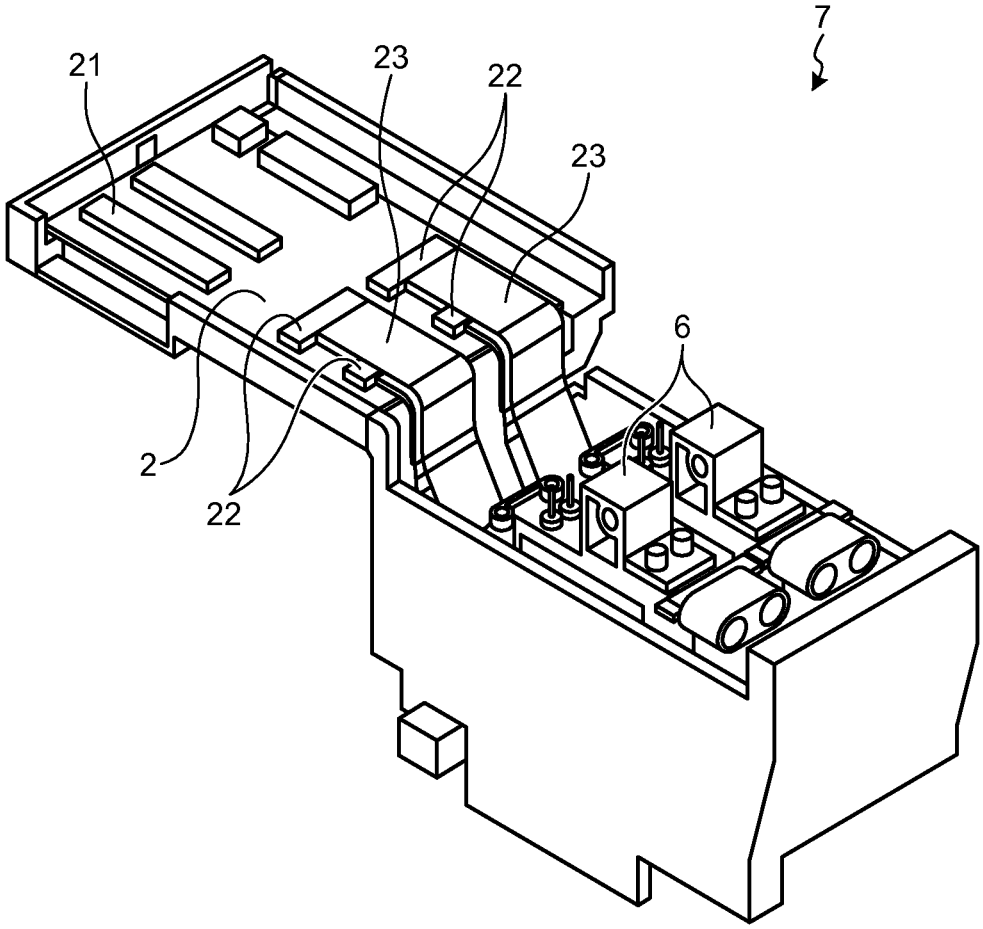
FIG. 8 is a perspective view of a carriage of the inkjet recording apparatus according to the embodiment.

The carriage 7 on which the relay board 2 is mounted is described below. FIG. 8 is a perspective view of the carriage 7 of the inkjet apparatus according to the present embodiment. The carriage 7 includes the relay board 2 and droplet ejection heads 6 as illustrated in FIG. 8. The relay board 2 further includes a body connector 21 and the head connectors 22. The carriage 7 also includes head connection flexible flat cables (FFCs) 23 that connect the relay board 2 to the droplet ejection heads 6.

Attached to the body connector 21 is a cable for connecting the relay board 2 to the apparatus body 1. Attached to the head connectors 22 are the head connection FFCs 23 for connecting the relay board 2 to the droplet ejection heads 6.

In an inkjet recording apparatus, a carriage moves at high speed during printing (recording). Therefore, weight reduction of the carriage is desired. However, a signal generator that generates drive signals for driving actuators has a complicated circuit structure because the signal generator is a composite of various types of electric components. In addition, a large component, such as a heat sink, is typically used as a solution to a problem of heat generation that stems from an increase in image quality in recent years. Under the circumstances, it is not desirable to mount the signal generator that generates the drive signals on the carriage to achieve weight reduction of the carriage described above.

Hence, in the inkjet recording apparatus according to the present embodiment, drive signals (drive waveforms) for driving the actuators are generated on a control board provided in the apparatus body 1. Input signals that include the generated drive signals are transmitted to the relay board 2 mounted on the carriage 7. The input signals received by the relay board 2 are applied to the droplet ejection heads 6 via the head connection FFCs 23.

Next, the droplet ejection head 6 is described below. The inkjet recording apparatus according to the embodiment includes two units of the droplet ejection heads 6. Two nozzle lines, which are made up of a plurality of nozzles, are formed on each of the droplet ejection heads 6.

Figure 9A:
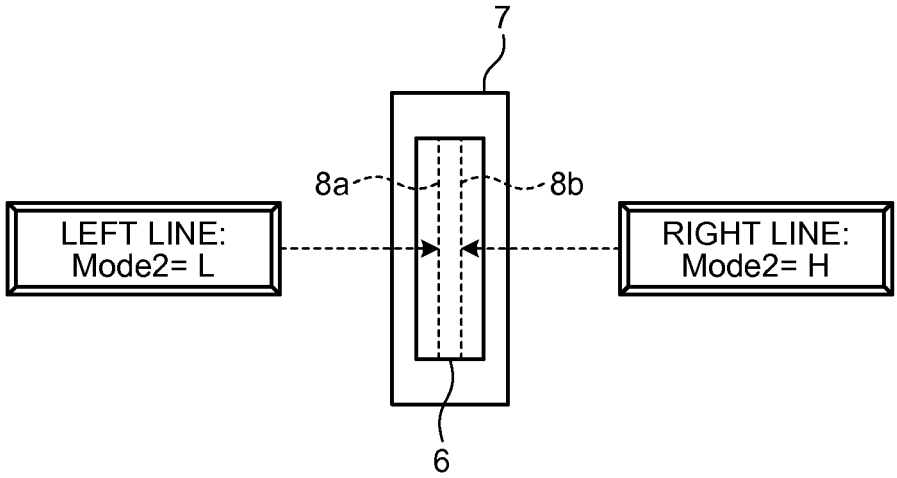
FIG. 9A is an explanatory diagram of control that is performed using the terminal arrangement signal on a per-nozzle-line basis.
Figure 9B:
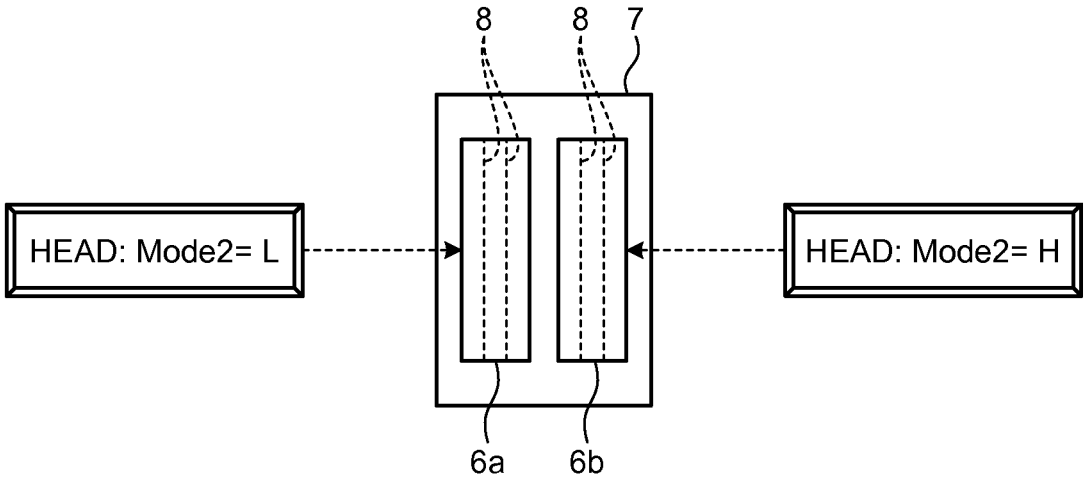
FIG. 9B is an explanatory diagram of control that is performed using the terminal arrangement signal on a per-droplet-ejection-head basis.

Control using the terminal arrangement signal according to the present embodiment can be performed on any one of a per-nozzle-line basis and a per-droplet-ejection-head-6 basis. The per-nozzle-line basis control is performed on each of the nozzle lines on a single unit of the droplet ejection heads 6 on the carriage 7. The per-droplet-ejection-head-6 basis control is performed on each of the droplet ejection heads 6 on the carriage 7. FIG. 9A is an explanatory diagram of the control that is performed using the terminal arrangement signal on the per-nozzle-line basis. FIG. 9B is an explanatory diagram of the control that is performed using the terminal arrangement signal on the per-droplet-ejection-nozzle basis.

Referring to FIG. 9A, the terminal arrangement signals (Mode2) are input to the left and right nozzle lines such that the signal (Mode2) of L is input to a left nozzle line 8*a*, while the signal (Mode2) of H is input to a right nozzle line 8*b*. The driver IC 30 that controls each of the nozzle lines on the single droplet ejection head 6 can thus change signal assignment to the arrangement of the input terminals 31.

Referring to FIG. 9B, the terminal arrangement signals (Mode2) are input to the right and left droplet ejection heads such that the signal (Mode2) of L is input to a left head 6*a* (which is common to the two nozzle lines 8), while the signal (Mode2) of H is input to a right head 6*b* (which is common to the two nozzle lines 8). The driver IC 30 that controls each of the heads and each of the nozzle lines in the single carriage can thus change signal assignment to the arrangement of the input terminals 31.

Figure 10:
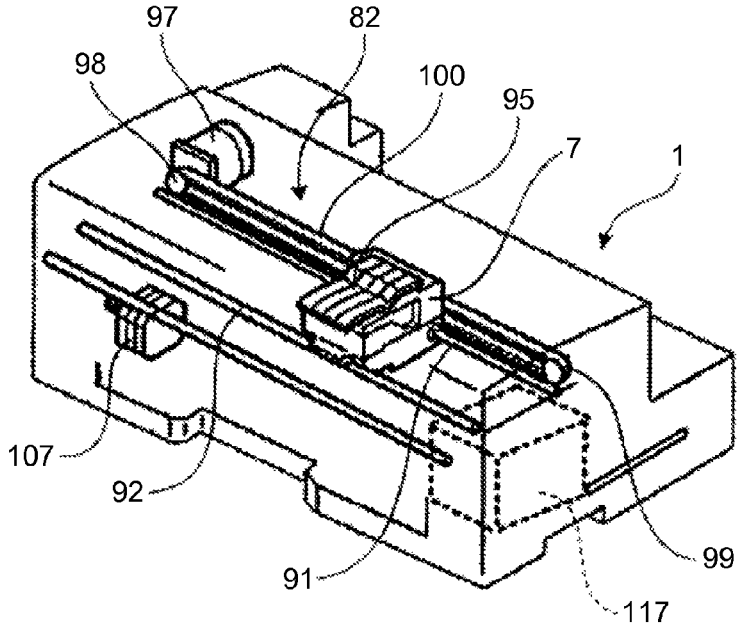
FIG. 10 is a perspective view of the inkjet recording apparatus.
Figure 11:
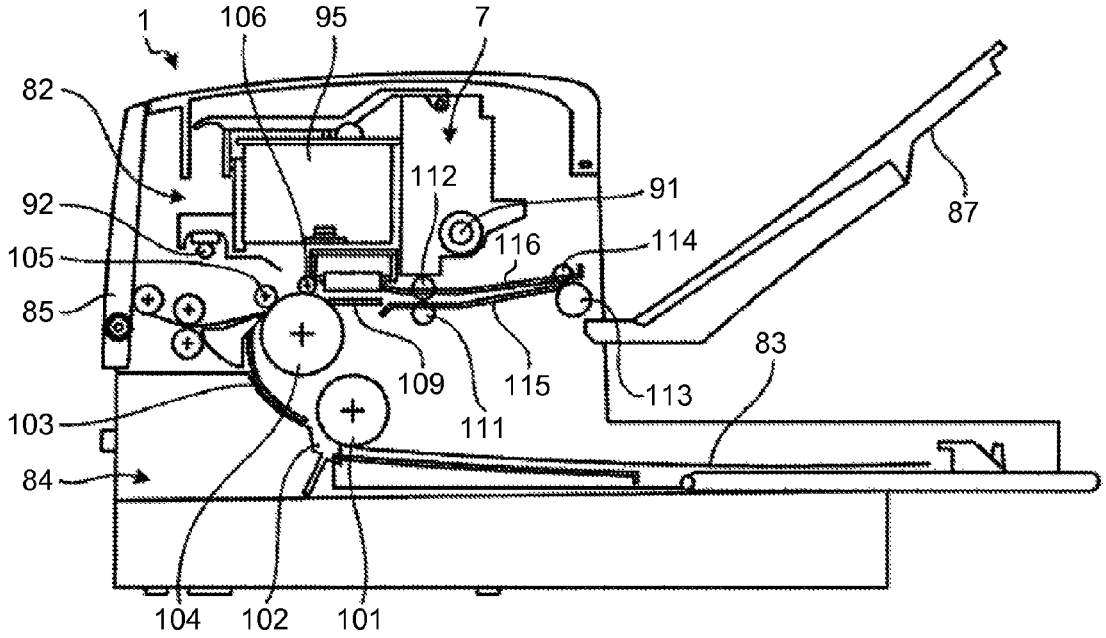
FIG. 11 is a cross-sectional view of the inkjet recording apparatus.

An example of the inkjet recording apparatus that includes the droplet ejection heads 6 according to the present embodiment is described below with reference to FIGS. 10 and 11. FIG. 10 is a perspective view of the inkjet recording apparatus. FIG. 11 is a cross-sectional view of the inkjet recording apparatus.

As illustrated in FIGS. 10 and 11, the inkjet recording apparatus includes, in the apparatus body 1, the carriage 7 that is movable in the main-scanning direction, the droplet ejection heads 6 mounted on the carriage 7, and a printing mechanism 82. The printing mechanism 82 includes ink cartridges 95 that supply ink to the droplet ejection heads 6. A sheet cassette 84 (or a sheet tray) on which a large number of sheets 83 can be loaded is detachably attached into a lower portion the apparatus body 1. The sheet cassette 84 is attached by being inserted from a front side. The inkjet recording apparatus also includes a bypass tray 85 that is pivotable to an open position for manual feeding of the sheet 83. The sheet 83 is fed from any one of the sheet cassette 84 and the bypass tray 85 to the printing mechanism 82 where a desired image is recorded on the sheet 83. Thereafter, the sheet 83 is discharged onto a sheet output tray 87 attached to the back side of the inkjet recording apparatus.

The printing mechanism 82 holds the carriage 7 with a main guide rod 91 and a sub guide rod 92 in such a manner as to allow the carriage 7 to slide in the main-scanning direction. The main guide rod 91 and the sub guide rod 92 are guide members horizontally laid across left and right side plates (not shown). Heads of the droplet ejection heads 6 that eject ink of different colors, which are yellow (Y), cyan (C), magenta (M), and black (Bk), are attached to the carriage 7. A plurality of nozzles are arranged on each of the heads in an orientation for ejecting ink downward and aligned in a direction crossing the main-scanning direction. Each of the ink cartridges 95 for supplying ink of a corresponding one of the colors to a corresponding head of the droplet ejection heads 6 is replaceably mounted on the carriage 7.

The ink cartridge 95 has an air vent that provides communication with the outside air in a top portion and a supply port for supplying ink to the droplet ejection head 6 in a bottom portion, and internally includes a porous member filled with ink. A capillary attraction of the porous member maintains the ink to be supplied to the head of the droplet ejection head 6 at a slight negative pressure. The heads for the respective multiple colors are used as the heads of the droplet ejection heads 6 in this example. Alternatively, a single head including nozzles for ejecting ink of multiple colors may be employed.

The carriage 7 is slidably fit in the main guide rod 91 at a back portion (on a downstream side with respect to a sheet conveying direction) of the carriage 7, and slidably mounted on the sub guide rod 92 at a front portion (on an upstream side with respect to the sheet conveying direction) of the carriage 7. A timing belt 100 is laid in a stretched manner across a driving pulley 98 and a driven pulley 99 that are rotated by a main-scan motor 97 to move the carriage 7 in the main-scanning direction for scanning. The timing belt 100 is fixed to the carriage 7. Rotating the main-scan motor 97 forward and backward causes the carriage 7 to reciprocate.

The inkjet recording apparatus also includes a sheet feeding roller 101 and a friction pad 102, a guide member 103, a conveying roller 104, a conveyance roller 105, and a leading-edge roller 106 to convey the sheet 83 loaded in the sheet cassette 84 to a position below the droplet ejection heads 6. The sheet feeding roller 101 and the friction pad 102 pick up and feed the sheet 83 from the sheet cassette 84. The guide member 103 guides the sheet 83. The conveying roller 104 reverses the fed sheet 83 and conveys the sheet 83. The conveyance roller 105 is pressed against a peripheral surface of the conveying roller 104. The leading-edge roller 106 defines an angle at which the sheet 83 is delivered from between the conveyance roller 105 and the conveying roller 104. The conveying roller 104 is rotated by a sub-scan motor 107 via a gear train.

The apparatus body 1 further includes a printed-sheet receiving member 109 which is a sheet guide member that guides, at a position lower than the droplet ejection heads 6, the sheet 83 delivered from the conveying roller 104 according to a movable range of the carriage 7 in the main-scanning direction. A conveyance roller 111 that is to be rotated to deliver the sheet 83 in a sheet discharge direction and a spur gear 112 are provided downstream of the printed-sheet receiving member 109 in the sheet conveying direction. Provided further downstream are sheet discharge rollers 113 and 114 that deliver the sheet 83 onto the sheet output tray 87 and guide members 115 and 116 that form a sheet discharge path.

Recording is performed as follows. While the carriage 7 is moved, the droplet ejection heads 6 are driven according to image signals, thereby ejecting ink onto the sheet 83 at rest to record one line. After the sheet 83 is conveyed a predetermined distance, a next line is recorded on the sheet 83. This recording operation ends when a recording-end signal or a signal indicating that a trailing end of the sheet 83 has reached a recording area is issued, and the sheet 83 is discharged.

A recovery device 117 for recovery from defective ejection of the droplet ejection heads 6 is arranged at a position outside the recording area on the right end side with respect to the moving direction of the carriage 7. The recovery device 117 includes a cap member, a suction unit, and a cleaning unit. During print standby, the carriage 7 is moved to the recovery device 117 where the cap member caps the droplet ejection heads 6 to keep the nozzles wet to prevent defective ejection caused by ink drying. Viscosities of ink of all the nozzles are kept constant by ejecting ink unrelated to recording during recording or the like to maintain stable ejection performance.

If defective ejection or the like should occur, the cap member seals the nozzles of the droplet ejection heads 6; the suction unit sucks air bubbles and the like together with ink from the nozzles through tubes; the cleaning unit removes ink, dusts, and the like sticking to nozzle surfaces. Thus, recovery from the defective ejection is achieved. The sucked ink is discharged into a waste ink reservoir (not shown) arranged in a bottom portion of the apparatus body to be absorbed and maintained by an ink absorber inside the waste ink reservoir.

As described above, the inkjet recording apparatus according to the present embodiment generates input signals that include the drive signals for driving the actuators and the terminal arrangement signal that indicates a type of assignment of signals to be assigned to the input terminals 31, and transmits the generated input signal to the driver IC 30 via the relay board 2. The driver IC 30 causes the actuators to be driven according to the drive signals included in the input signals, thereby causing ink to be ejected from the nozzles. At this time, the driver IC 30 changes the assignment of signals to be assigned to the input terminals 31 in accordance with the terminal arrangement signal included in the input signals.

Thus, even when input signals arranged in a different sequence are transmitted from the relay board 2 to the driver IC 30, the driver IC 30 of the single type is capable of receiving such input signals by changing assignment of signals to be assigned to the input terminals 31. Thus, wiring on the relay board 2 on a side from which the input signals are transmitted can be simplified. Therefore, the number of layers of the relay board 2 can be reduced without wire crossing. Reducing the number of layers of the relay board 2 in this way simplifies the layer structure. As a result, manufacturing cost of the inkjet recording apparatus can be reduced.

In the present embodiment, the example in which the droplet ejection apparatus according to an aspect of the present invention is applied to the inkjet recording apparatus has been described. However, the droplet ejection apparatus is applicable to any apparatus that performs recording by ejecting droplets. Examples of the apparatus include a copier, a printer, a scanner, a facsimile, and a multifunction peripheral that has at least two functions of a copier function, a printer function, a scanner function, and a facsimile function.

According to an embodiment, an effect that a layer structure of a circuit board on a side from which input signals are transmitted is simplified to thereby reduce manufacturing cost is yielded.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A circuit device that drives actuator elements respectively associated with a plurality of nozzles to cause droplets to be ejected from the nozzles, the circuit device comprising:

input terminals;

a receiving unit that receives, via the input terminals, input signals including a terminal arrangement signal and drive signals for driving the actuator elements, the terminal arrangement signal indicating a type of assignment of signals to be assigned to the input terminals;

a switching unit that switches the assignment of signals in accordance with the terminal arrangement signal; and a transfer unit that transfers, to the actuator elements, drive signals that are input to the input terminals after the assignment of signals has been switched.

2. The circuit device according to claim 1, wherein when the terminal arrangement signal indicates a first type, the switching unit switches the assignment of signals to a first assignment in which the signals are assigned to the input terminals in a first signal order, and when the terminal arrangement signal indicates a second type, the switching unit switches the assignment of signals to a second assignment in which the signals are assigned to the input terminals in a second signal order that is reversed order of the first signal order.

3. The circuit device according to claim 2, wherein when the receiving unit receives the first signal type, first switches in the input terminals are put in a first position, while second switches in the input terminals are put in the OFF position, and when the receiving unit receives the second signal type, the first switches are put in the OFF position, while the second switches are put in the ON position.

4. The circuit device according to claim 3, wherein a signal order assigned to input terminals is reversed when the switches are changed from the first position to the second position.

5. A droplet ejection apparatus that ejects droplets from a plurality of nozzles, the droplet ejection apparatus comprising:

a circuit device that includes input terminals and drives actuator elements, the actuator elements individually being respectively associated with the plurality of nozzles;

a signal generator that generates input signals including a terminal arrangement signal and drive signals for driving the actuator elements, the terminal arrangement signal indicating a type of assignment of signals to be assigned to the input terminals; and a transmitting unit that transmits the input signals to the circuit device, wherein the circuit device includes:

a receiving unit that receives, via the input terminals, the input signals;

a switching unit that switches the assignment of signals in accordance with the terminal arrangement signal; and a transfer unit that transfers, to the actuator elements, drive signals that are input to the input terminals after the assignment of signals has been switched.

6. The droplet ejection apparatus according to claim 5, wherein when the terminal arrangement signal indicates a first type, the switching unit switches the assignment of signals to a first assignment in which the signals are assigned to the input terminals in a first signal order, and when the terminal arrangement signal indicates a second type, the switching unit switches the assignment of signals to a second assignment in which the signals are assigned to the input terminals in a second signal order that is reversed order of the first signal order.

7. The droplet ejection apparatus according to claim 5, further comprising a flexible printed circuit, wherein the circuit device is mounted on the flexible printed circuit.

8. The droplet ejection apparatus according to claim 7, further comprising a relay board on which a wiring pattern is formed, wherein the flexible printed circuit is connected to a body of the droplet ejection apparatus via the relay board.

9. The information processing apparatus according to claim 8, further comprising a movable carriage, wherein the relay board is mounted on the carriage.

10. The droplet ejection apparatus according to claim 9, wherein the carriage includes at least one droplet ejection head including at least two nozzle lines made up of the plurality of nozzles.

11. The droplet ejection apparatus according to claim 5, wherein when the receiving unit receives the first signal type, first switches in the input terminals are put in a first position, while second switches in the input terminals are put in the OFF position, and when the receiving unit receives the second signal type, the first switches are put in the OFF position, while the second switches are put in the ON position.

12. The droplet ejection apparatus according to claim 11, wherein a signal order assigned to input terminals is reversed when the switches are changed from the first position to the second position.

* * * * *